US012337437B2

(12) United States Patent
Nishijima

(10) Patent No.: US 12,337,437 B2
(45) Date of Patent: Jun. 24, 2025

(54) BARREL POLISHING DEVICE

(71) Applicant: SINTOKOGIO, LTD., Nagoya (JP)

(72) Inventor: Hitoshi Nishijima, Aichi (JP)

(73) Assignee: SINTOKOGIO, LTD., Nagoya (JP)

( * ) Notice: Subject to any disclaimer, the term of this patent is extended or adjusted under 35 U.S.C. 154(b) by 754 days.

(21) Appl. No.: 17/436,372

(22) PCT Filed: Mar. 11, 2020

(86) PCT No.: PCT/JP2020/010646
§ 371 (c)(1),
(2) Date: Sep. 3, 2021

(87) PCT Pub. No.: WO2020/203131
PCT Pub. Date: Oct. 8, 2020

(65) Prior Publication Data

US 2022/0143777 A1 May 12, 2022

(30) Foreign Application Priority Data

Mar. 29, 2019 (JP) ..... 2019-066610

(51) Int. Cl.
*B24B 31/108* (2006.01)
*B24B 31/02* (2006.01)

(52) U.S. Cl.
CPC ..... *B24B 31/108* (2013.01); *B24B 31/02* (2013.01)

(58) Field of Classification Search
CPC ..... B24B 31/108; B24B 31/02
(Continued)

(56) References Cited

U.S. PATENT DOCUMENTS 4,958,776 A 9/1990 Walther
5,189,842 A 3/1993 Kobayashi et al.
(Continued)

FOREIGN PATENT DOCUMENTS

EP 1782895 A1 * 5/2007 ..... B08B 5/00
JP S51-003494 A 1/1976
(Continued)

OTHER PUBLICATIONS

Grease Basics found at: https://web.archive.org/web/20170223175127/https://www.machinerylubrication.com/Read/1352/grease-basics (Year: 2017).*

(Continued)

*Primary Examiner* — Edward F Landrum
*Assistant Examiner* — Caleb Andrew Holizna
(74) *Attorney, Agent, or Firm* — Faegre Drinker Biddle & Reath LLP

(57) ABSTRACT

A barrel polishing apparatus according to an aspect includes a fixed tank and a rotary disk that define a polishing space. The fixed tank has a predetermined axis as a center axis. The fixed tank includes a cylindrical rigid body and a first lining covering an inner circumferential surface of the cylindrical rigid body. The rotary disk has a disk-shaped rigid body and a second lining covering a surface of the disk-shaped rigid body on the polishing space side, and is rotatably disposed in a state where a gap is formed between the first lining and the second lining. The disk-shaped rigid body has a convex portion protruding toward the polishing space along a predetermined axis direction. The length in the predetermined axis direction of the part overlapping the gap of the convex portion is one-third or more of the length in the predetermined axis direction of the gap.

7 Claims, 5 Drawing Sheets

(58) Field of Classification Search
USPC ..... 451/326, 327, 328
See application file for complete search history.

(56) References Cited

U.S. PATENT DOCUMENTS

| | | | | |
|---|---|---|---|---|
| 5,823,861 | A | 10/1998 | Kobayashi et al. | |
| 2002/0028630 | A1* | 3/2002 | Kobayashi | B24B 31/12 451/53 |

FOREIGN PATENT DOCUMENTS

| | | | |
|---|---|---|---|
| JP | H2-502088 | A | 7/1990 |
| JP | H05-38670 | A | 2/1993 |
| JP | H07-314322 | A | 12/1995 |
| JP | H9-225808 | A | 9/1997 |
| JP | H10-277917 | A | 10/1998 |
| JP | 2001-088006 | A | 4/2001 |
| JP | 3163812 | U | 11/2010 |
| WO | WO-89/003281 | A1 | 4/1989 |

OTHER PUBLICATIONS

International Preliminary Report on Patentability issued Oct. 14, 2021 in WO Patent Application No. PCT/JP2020/010646.
Korean Office Action issued Apr. 8, 2024 in Application No. 10-2021-7033616.

* cited by examiner

*Fig.5*

| TEMPERATURE (°C) | EXAMPLE 1 AMOUNT OF CHANGE (mm/°C) | EXAMPLE 2 AMOUNT OF CHANGE (mm/°C) | EXAMPLE 3 AMOUNT OF CHANGE (mm/°C) |
|---|---|---|---|
| REFERENCE TEMPERATURE T | 0 | 0 | 0 |
| T+5 | 0.01126981 | 0.013120134 | 0.014362144 |
| T+10 | 0.011268231 | 0.013117993 | 0.014359579 |
| T+15 | 0.011266652 | 0.013115854 | 0.014357016 |
| T+20 | 0.011265074 | 0.013113716 | 0.014354454 |
| T+25 | 0.011263497 | 0.013111579 | 0.014351894 |
| T+30 | 0.011261921 | 0.013109443 | 0.014349335 |
| T+35 | 0.011260345 | 0.013107308 | 0.014346777 |
| T+40 | 0.011258769 | 0.013105174 | 0.01434422 |
| T+45 | 0.011257195 | 0.013103041 | 0.014341665 |
| T+50 | 0.011255621 | 0.013100909 | 0.014339112 |
| AVERAGE AMOUNT OF CHANGE | 0.0113 | 0.0131 | 0.0144 |

BARREL POLISHING DEVICE

TECHNICAL FIELD

The present disclosure relates to a barrel polishing apparatus.

BACKGROUND ART

A flow-type barrel polishing apparatus that polishes a workpiece by causing the workpiece to flow together with abrasives in a polishing space is used. Generally, the flow-type barrel polishing apparatus includes a cylindrical fixed tank and a rotary disk disposed to close a lower opening of the fixed tank. A lining having wear resistance is formed on the inner wall surface of the fixed tank and the surface of the rotary disk on the polishing space side. A gap is formed between the lining of the fixed tank and the lining of the rotary disk, and the rotary disk rotates with respect to the fixed tank while maintaining the gap.

In the flow-type barrel polishing apparatus, when the temperature in the polishing space is increased by polishing the workpiece for a long time, the linings of the fixed tank and the rotary disk thermally expand, and the width of the gap formed between the fixed tank and the rotary disk may be narrowed. When the lining of the fixed tank and the lining of the rotary disk come into contact with each other as the expansion of the lining progresses, the lining of the fixed tank and the lining of the rotary disk are welded to each other by frictional heat, and the rotary disk becomes non-rotatable.

A barrel polishing apparatus described in Patent Document 1 is known as a technique for controlling the width of a gap formed between the fixed tank and the rotary disk. The barrel polishing apparatus of Patent Document 1 includes a cylindrical fixed tank and a rotary disk that closes a lower opening of the fixed tank. The fixed tank has a cylindrical metal wall and a lining layer formed on an inner circumferential surface of the metal wall. The rotary disk includes a disk-shaped metal member and a lining layer formed on a surface of the metal member. A small gap portion is formed between the lining layer of the fixed tank and the lining layer of the rotary disk. A retreat layer is formed between the metal wall of the fixed tank and the lining layer.

CITATION LIST

Patent Literature

Patent Document 1: Japanese Unexamined Patent Publication No. 10-277917

SUMMARY OF INVENTION

Technical Problem

In the barrel polishing apparatus of Patent Document 1, the lining layer of the fixed tank is expanded toward the retreat layer to prevent the expansion from progressing toward the gap, thereby preventing the width of the small gap portion from being narrowed. However, in the barrel polishing apparatus of Patent Document 1, since no measure is taken to suppress the expansion of the lining layer of the rotary disk toward the small gap portion, the width of the small gap portion is narrowed by the expansion of the lining layer of the rotary disk. Therefore, in the barrel polishing apparatus of Patent Document 1, it is necessary to increase the width of the small gap portion to some extent so as to allow the expansion of the lining layer of the rotary disk. Therefore, when the width of the small gap portion is set to be large, it may be difficult to polish the small workpiece or the like in order to avoid the workpiece from being caught in the small gap portion.

Therefore, it is required to provide a barrel polishing apparatus capable of reducing the amount of change in the width of the gap between the fixed tank and the rotary disk due to the expansion of the lining.

Solution to Problem

A barrel polishing apparatus according to an aspect includes a fixed tank and a rotary disk that define a polishing space. The fixed tank has a predetermined axis as a center axis. The fixed tank includes a cylindrical rigid body and a first lining covering an inner circumferential surface of the cylindrical rigid body. The rotary disk has a disk-shaped rigid body and a second lining covering a surface of the disk-shaped rigid body on the polishing space side, and is rotatably disposed in a state where a gap is formed between the first lining and the second lining. The disk-shaped rigid body has a convex portion protruding toward the polishing space along a predetermined axis direction, and the convex portion is surrounded by the second lining. When viewed from a direction orthogonal to the predetermined axis, the convex portion overlaps the gap, and a length of a part overlapping the gap of the convex portion in the predetermined axis direction is one third or more of a length of the gap in the predetermined axis direction.

In the barrel polishing apparatus according to the above aspect, the disk-shaped rigid body of the rotary disk is provided with the convex portion protruding toward the polishing space along the predetermined axis direction, and the convex portion is disposed so as to overlap the gap. Since the convex portion restricts the expansion of the second lining in the outer circumferential direction (the gap side), the expansion of the second lining proceeds in the predetermined axis direction. Therefore, the amount of change in the width of the gap due to the expansion of the second lining can be reduced.

In one embodiment, the disk-shaped rigid body may have a central region and an outer region surrounding the central region, the convex portion may be provided in the outer region, and a thickness of the second lining on the convex portion may be greater than a thickness of the second lining on the central region. The second lining on the outer region is more likely to be worn than the second lining on the central region. By making the thickness of the second lining on the convex portion greater than the thickness of the second lining on the central region, the second lining on the convex portion is worn and the convex portion is hardly exposed to the polishing space. Therefore, the life of the barrel polishing apparatus can be improved.

In one embodiment, the disk-shaped rigid body may have a disk shape, and the convex portion may be provided at a radially outer end portion of the disk-shaped rigid body. In this embodiment, since the convex portion is disposed in the vicinity of the gap, expansion of the second lining toward the gap can be further suppressed.

In one embodiment, a retreat space may be formed between the inner circumferential surface of the cylindrical rigid body and the first lining, and the retreat space may be formed at a position overlapping the gap when viewed from a direction orthogonal to the predetermined axis direction. In this embodiment, since the expansion of the first lining toward the retreat space side can be promoted, the expansion of the first lining layer toward the gap side can be suppressed.

In one embodiment, a passage communicating with the gap and the retreat space may be formed on a side opposite to the polishing space of the disk-shaped rigid body, and an elastic member may be provided in the passage so as to cover an end portion of the retreat space on the passage side. In this embodiment, since the end portion of the retreat space on the communication space side is sealed, it is possible to prevent the polishing liquid or the like having passed through the gap from entering the retreat space.

In one embodiment, the elastic member may be a sponge packing. Since the sponge packing is inexpensive and easy to construct, the end portion on the communication space side of the retreat space can be easily sealed.

In one embodiment, the sponge packing may be fixed by a flange. In this embodiment, the sponge packing can be prevented from falling off.

Advantageous Effects of Invention

According to one aspect and various embodiments of the present invention, it is possible to reduce the amount of change in the width of the gap between the fixed tank and the rotary disk due to expansion of the lining.

BRIEF DESCRIPTION OF DRAWINGS

FIG. 5 is data showing the relationship between the temperature of the second lining and the amount of change in the radius of the outer peripheral surface of the second lining.

DESCRIPTION OF EMBODIMENTS

Figure 1:
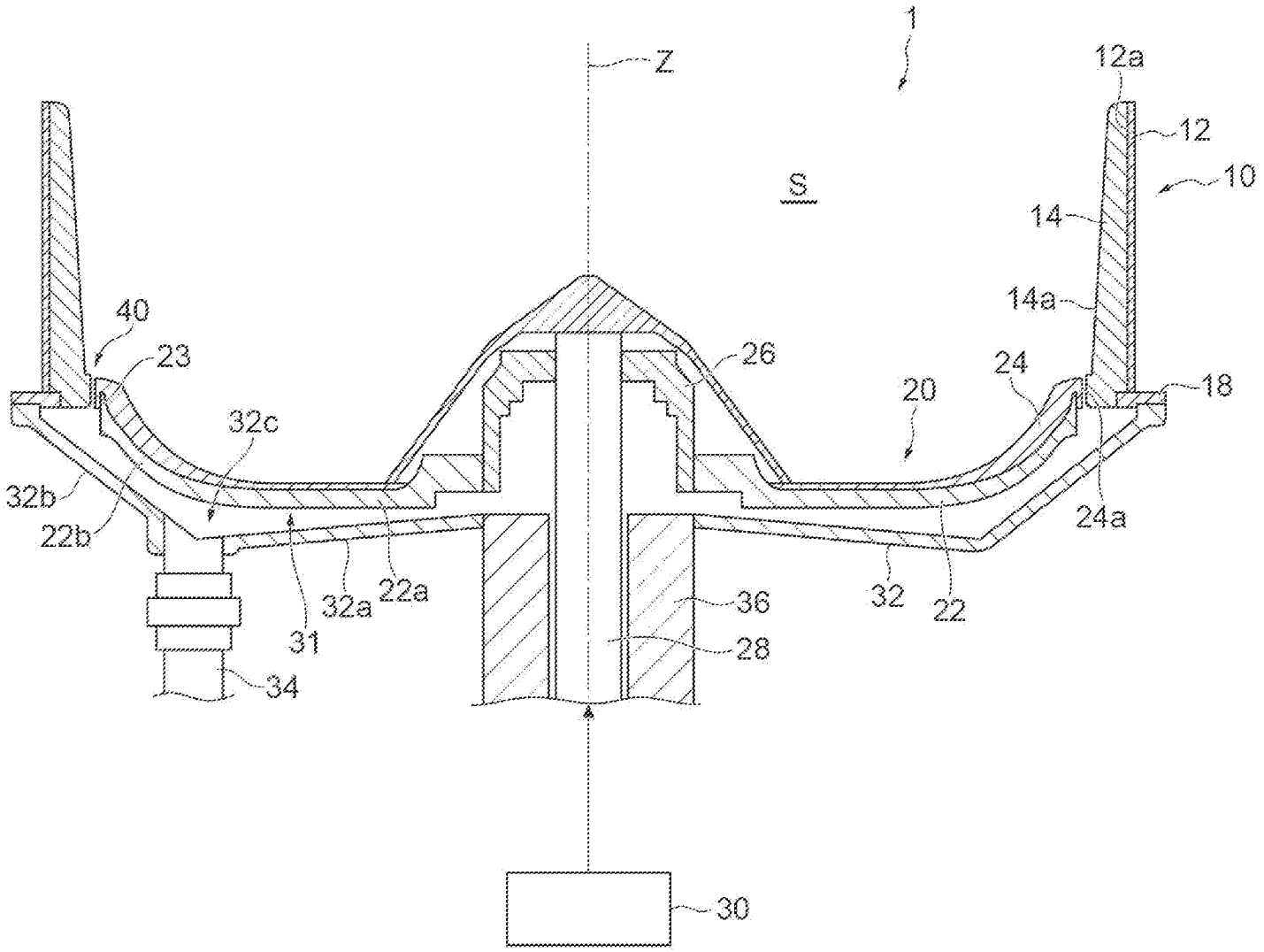
FIG. 1 is a cross-sectional view schematically illustrating a barrel polishing apparatus according to an embodiment.

Hereinafter, embodiments of the present disclosure will be described with reference to the drawings. In the following description, the same or corresponding element is denoted by the same reference numeral, and redundant description will not be repeated. Dimensional ratios in the drawings do not necessarily match those in the description. The words "up," "down," "left," and "right" are based on the states shown and are for convenience.

FIG. 1 is a cross-sectional view schematically illustrating a barrel polishing apparatus according to an embodiment. A barrel polishing apparatus 1 shown in FIG. 1 is an apparatus for polishing a workpiece, and includes a fixed tank 10 and a rotary disk 20. The barrel polishing apparatus 1 is a so-called flow-type barrel polishing apparatus, and the rotary disk 20 rotates with respect to the fixed tank 10 to polish the workpiece charged therein.

As shown in FIG. 1, the fixed tank 10 includes a cylindrical rigid body 12 and a first lining 14. The cylindrical rigid body 12 is formed of a rigid body such as metal and has a cylindrical shape. The center axis of the cylindrical rigid body 12 coincides with the axis Z of the barrel polishing apparatus 1.

The inner circumferential surface 12*a* of the cylindrical rigid body 12 is covered by the first lining 14. The first lining 14 has a substantially cylindrical shape and is made of a wear-resistant material. The first lining 14 has a function of preventing the cylindrical rigid body 12 from being worn when the workpiece is polished. The material of the first lining 14 is exemplified by urethane resin, but is not limited to urethane resin as long as it is a polymer material having abrasion resistance.

A flange 18 is provided below the cylindrical rigid body 12. The flange 18 has an annular shape and is fixed to the cylindrical rigid body 12.

The flange 18 is supported by a support disk 32. The support disk 32 has a disk shape in which an opening is formed in a central portion thereof, and a radially inner end portion thereof is fixed to the base portion 36. The support disk 32 includes an inner region 32*a* that is inclined downward toward the radially outer side and an outer region 32*b* that is inclined upward toward the radially outer side. A retention portion 32*c* is formed between the inner region 32*a* and the outer region 32*b*. A discharge pipe 34 is connected to the support disk 32 so as to communicate with the retention portion 32*c*.

The rotary disk 20 is provided to close the lower opening of the fixed tank 10. The rotary disk 20 defines a polishing space S for polishing the workpiece together with the fixed tank 10. The rotary disk 20 has a disk-shaped rigid body 22 and a second lining 24.

The disk-shaped rigid body 22 is provided above the support disk 32. The disk-shaped rigid body 22 is made of a rigid material such as metal and has a disk shape with an opening formed at the center thereof. The disk-shaped rigid body 22 has a central region 22*a* and an outer region 22*b* provided so as to surround the central region 22*a*. In the outer region 22*b* of the disk-shaped rigid body 22, a convex portion 23 protruding toward the polishing space S along the axis Z direction is formed. The convex portion 23 will be described in detail later.

The upper surface (surface on the polishing space S side) of the disk-shaped rigid body 22 is covered with the second lining 24. The second lining 24 has a disk shape in which an opening is formed at the center thereof, and is made of a wear-resistant material. The second lining 24 has a function of preventing the disk-shaped rigid body 22 from being worn when the workpiece is polished. The material of the second lining 24 is exemplified by urethane resin, but is not limited to urethane resin as long as it is a polymer material having abrasion resistance.

A gap 40 for allowing rotation of the rotary disk 20 is formed between the inner circumferential surface 14*a* of the first lining 14 and the end surface 24*a* of the second lining 24. In order to prevent the workpiece in the polishing space S from falling from the gap 40, a distance between an inner circumferential surface 14*a* of the first lining 14 and an end surface 24*a* of the second lining 24 (Width d of the gap 40 described later) is designed to be smaller than width of the workpiece.

In addition, a radially inner end portion of the disk-shaped rigid body 22 is fixed to the coupling member 26, and the coupling member 26 is fixed to the rotating shaft 28. The rotating shaft 28 extends along the axis Z and is rotatable about the axis Z. A motor 30 is connected to the rotating shaft 28. The motor 30 generates a driving force for rotating the rotating shaft 28 about the axis Z, and transmits the driving force to the rotating shaft 28 via a transmission mechanism. When the driving force of the motor 30 is transmitted to the rotating shaft 28, the disk-shaped rigid body 22 rotates about the axis Z while the gap 40 is formed between the first lining 14 and second lining 24.

When the disk-shaped rigid body 22 is rotated about the axis Z, the workpiece and the polishing media are spirally moved in the polishing space S by centrifugal force. In the process of this flow, the workpiece and the polishing media collide with each other to polish the workpiece. When wet barrel polishing is performed, workpiece and polishing media, as well as water and compound, are introduced into the polishing space S and flowed therein.

A passage 31 is formed between the disk-shaped rigid body 22 and the support disk 32. That is, the passage 31 is formed on the side opposite to the polishing space S of the disk-shaped rigid body 22. Passage 31 is a passage used for discharging polishing debris of the workpiece generated by the barrel polishing, fragments of the polishing media (hereinafter, the polishing debris of the workpiece and the fragments of the polishing media are collectively referred to as "chips"), or a polishing liquid containing chips. The passage 31 communicates with the gap 40 and a retreat space 42 described later. The chips and the polishing liquid generated by the barrel polishing in the polishing space S pass through the gap 40 formed between the first lining 14 and the second lining 24 and are collected in the passage 31. The chips and the polishing liquid collected in the passage 31 are collected in the retention portion 32*c* and discharged from the discharge pipe 34 to the outside of the barrel polishing apparatus 1.

Next, the fixed tank 10 will be described in detail with reference to FIG. 2.

Figure 2:
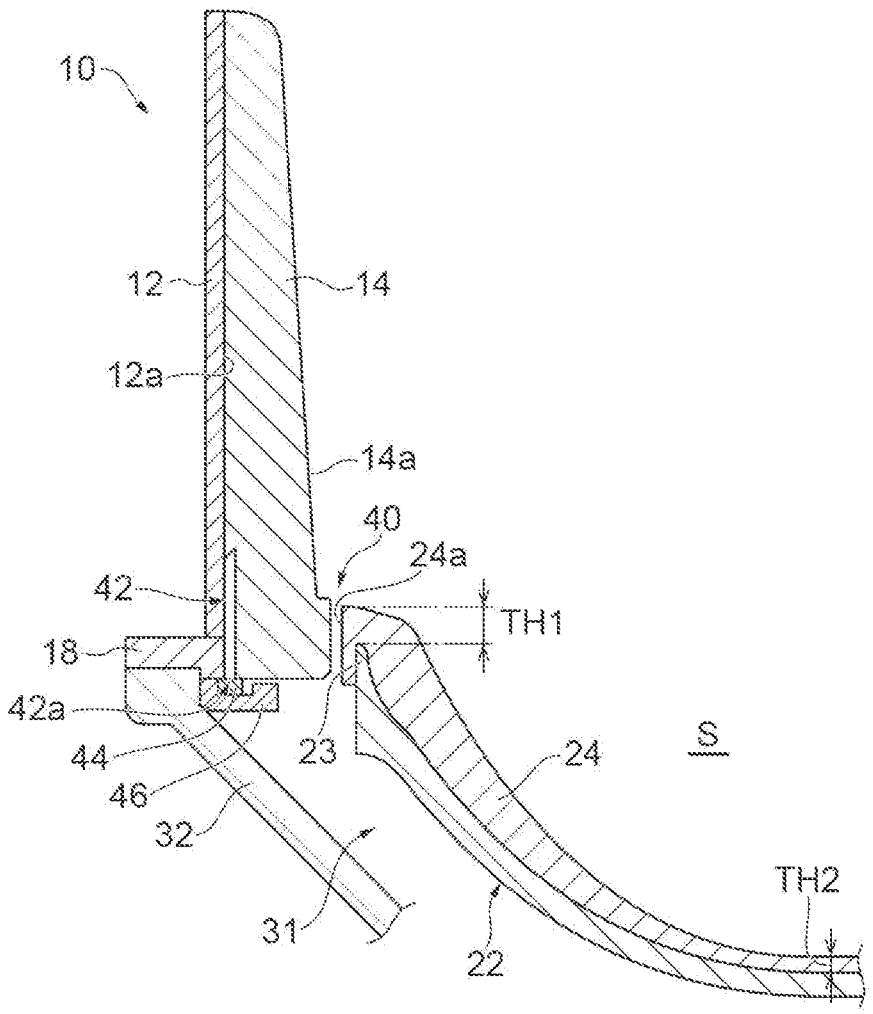
FIG. 2 is an enlarged cross-sectional view of a part of the barrel polishing apparatus.

As shown in FIG. 2, a retreat space 42 is formed between the inner circumferential surface 12*a* of the cylindrical rigid body 12 of the fixed tank 10 and the first lining 14. More specifically, the retreat space 42 is formed between the cylindrical rigid body 12 and the first lining 14. The retreat space 42 is formed at a position overlapping with the gap 40 when viewed from a direction orthogonal to the axis Z (the left-right direction in FIG. 2).

When the workpiece introduced into the polishing space S is subjected to barrel polishing, the temperature in the polishing space S rises due to frictional heat between the workpiece and the polishing media as the polishing time elapses. When the temperature of the first lining 14 rises with a rise in the temperature of the polishing space S, the first lining 14 thermally expands and its volume increases. At this time, since the first lining 14 has a cylindrical shape, the first lining 14 expands in the radial direction and enters the retreat space 42. On the other hand, the expansion of the first lining 14 toward the radially inner side is suppressed by an amount corresponding to the expansion of the first lining 14 toward the radially outer side. As a result, narrowing of the width d of the gap 40 (see FIG. 3) is suppressed.

As shown in FIG. 2, an annular elastic member 44 is provided in the passage 31, and an end portion 42*a* of the retreat space 42 on the passage 31 side is covered with the elastic member 44. The elastic member 44 is formed of an elastic body that does not inhibit the movement of the first lining 14, such as sponge packing, soft silicon packing, or caulking. In particular, when a sponge packing is adopted, the cost is low and the construction is easy. The elastic member 44 is fixed to the flange 18 by the flange 46. The elastic member 44 prevents chips and polishing liquid passing through the gap 40 from entering the retreat space 42. In one embodiment, a part of the retreat space 42 may extend in a meandering manner between the first lining 14 and the cylindrical rigid body 12 or between the first lining 14 and the flange 18. In order to more reliably prevent the chips and the polishing liquid from entering the retreat space 42, grease may be filled in the retreat space 42.

Figure 3:
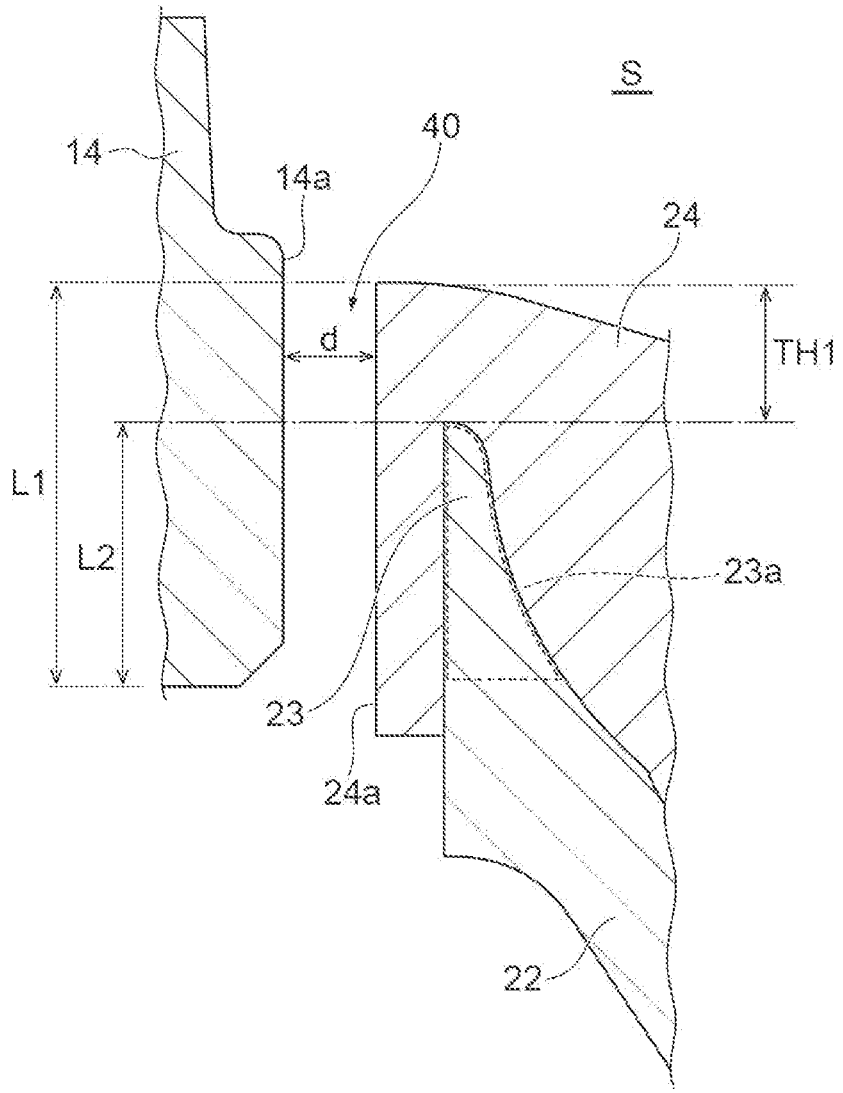
FIG. 3 is a cross-sectional view around the gap.

Next, the rotary disk 20 and the gap 40 will be described in detail with reference to FIGS. 2 and 3. As described above, the gap 40 is formed between the inner circumferential surface 14*a* of the first lining 14 and the end surface 24*a* on the outer circumferential side of the second lining 24. In the cross-sectional views shown in FIGS. 2 and 3, the inner circumferential surface 14*a* and the end surface 24*a* are arranged so as to face each other with a gap 40 interposed therebetween, and the gap 40 extends in a direction parallel to the axis Z between the inner circumferential surface 14*a* and the end surface 24*a*. As shown in FIG. 3, the gap 40 has a length L1 in the axis Z direction and a width d in the direction orthogonal to the axis Z.

A convex portion 23 is formed in the outer region 22*b* of the disk-shaped rigid body 22, more specifically, in a radially outer end portion of the disk-shaped rigid body 22. The convex portion 23 protrudes from the disk-shaped rigid body 22 in a direction parallel to the extending direction of the gap 40, that is, in the axis Z direction. The periphery of the convex portion 23 is covered with the second lining 24 so that the convex portion 23 is not exposed to the gap 40. Since the periphery of the convex portion 23 is covered with the second lining 24 in this manner, the convex portion 23 is prevented from being worn by the chips or the polishing liquid passing through the gap 40.

The convex portion 23 is disposed so as to at least partially overlap the gap 40 when viewed from a direction orthogonal to the axis Z direction (the left-right direction in FIGS. 2 and 3). Here, when viewed from the direction orthogonal to the axis Z, the overlapping part 23*a* overlapping the gap 40 of the convex portion 23 has a length L2 in the axis Z direction. The length L2 of the overlapping part 23*a* is set to one-third (⅓) or more of the length L1 of the gap 40. The length L2 of the overlapping part 23*a* may be set to a half or more of the length L1 of the gap 40.

The convex portion 23 has a function of restricting expansion of the second lining 24 toward the gap 40 (toward the outer periphery). That is, when the workpiece is polished in the polishing space S and the temperature in the polishing space S rises, the second lining 24 thermally expands and the second lining 24 increases in volume. Here, when the convex portion 23 extending in the axis Z direction is provided, the expansion of the second lining 24 toward the gap 40 side (outer circumferential side) is restricted, and the expansion of the second lining 24 proceeds toward the polishing space S side (the axis Z direction). Therefore, narrowing of the width d of the gap 40 due to expansion of the second lining 24 is suppressed. In particular, since the length L2 of the overlapping part 23*a* of the convex portion 23 is set to one-third or more of the length L1 of the gap 40, it is possible to more reliably suppress the width d of the gap 40 from being narrowed.

As shown in FIG. 2, the second lining 24 formed on the convex portion 23 has a thickness TH1 larger than a thickness TH2 of the second lining formed on the central region 22*a*. In the flow-type barrel polishing, since centrifugal force is generated by the rotation of the disk-shaped rigid body 22 and the workpiece and the polishing media spirally flow in the region on the fixed tank 10 side in the polishing space S, the outer part of the second lining 24 (the part formed on the outer region 22*b* of the second lining) is worn faster than the inner part of the second lining 24 (the part formed on the central region 22*a* of the second lining). At this time, by making the thickness TH1 of the second lining 24 on the convex portion 23 larger than the thickness TH2 of the second lining 24 on the central region 22*a*, the second lining 24 is prevented from being worn and the convex portion 23 is prevented from being exposed to the polishing space S. Therefore, the life of the barrel polishing apparatus 1 can be improved.

Hereinafter, the operation and effect of the barrel polishing apparatus 1 according to the embodiment will be described. In barrel polishing using this barrel polishing apparatus, workpiece, polishing media, water and compound are introduced into the polishing space S. Next, the rotary disk 20 rotates around the axis Z in a state where the gap 40 is formed between the first lining 14 and the second lining 24. By the rotation of the rotary disk 20, workpiece and the like flow in the polishing space S. In this process, a part of the chips and the polishing liquid generated by the barrel polishing pass through the gap 40 and are collected in the passage 31. The chips and the polishing liquid collected in the passage 31 are collected in the retention portion 32*c* and discharged from the discharge pipe 34 to the outside of the barrel polishing apparatus 1.

In the process of barrel polishing, the temperature in the polishing space S rises due to frictional heat between the workpiece and the polishing media. As the temperature of the polishing space S rises, the first lining 14 and the second lining 24 are heated and thermally expanded. At this time, since the first lining 14 expands radially outward due to the presence of the retreat space 42, expansion toward the gap 40 side is suppressed. On the other hand, the second lining 24 is restricted from expanding toward the gap 40 (radially outward) by the presence of the convex portion 23, and therefore expands mainly toward the polishing space S. Therefore, the width d of the gap 40 is prevented from narrowing due to thermal expansion of the first lining 14 and the second lining 24. That is, the width d of the gap 40 is prevented from decreasing. As a result, even when the width d of the gap 40 at a reference temperature is designed to be small, the first lining 14 and the second lining 24 are less likely to come into contact with each other, so that a small workpiece can be polished.

Next, the operation and effect of the barrel polishing apparatus 1 will be described based on examples with reference to FIG. 4, but the present invention is not limited to the following examples.

In the examples, the amount of change in the radius of the outer peripheral surface of the second lining 24 when the length L2 of the overlapping part 23*a* was changed was obtained by simulation and evaluated. In the following Examples 1 to 3, the length L1 of the gap 40 in the axis Z direction was 27 mm. The radius of the outer peripheral surface of the second lining 24 at a reference temperature was 804 mm, and the linear expansion coefficient of the second lining 24 was 0.0002.

Figure 4:
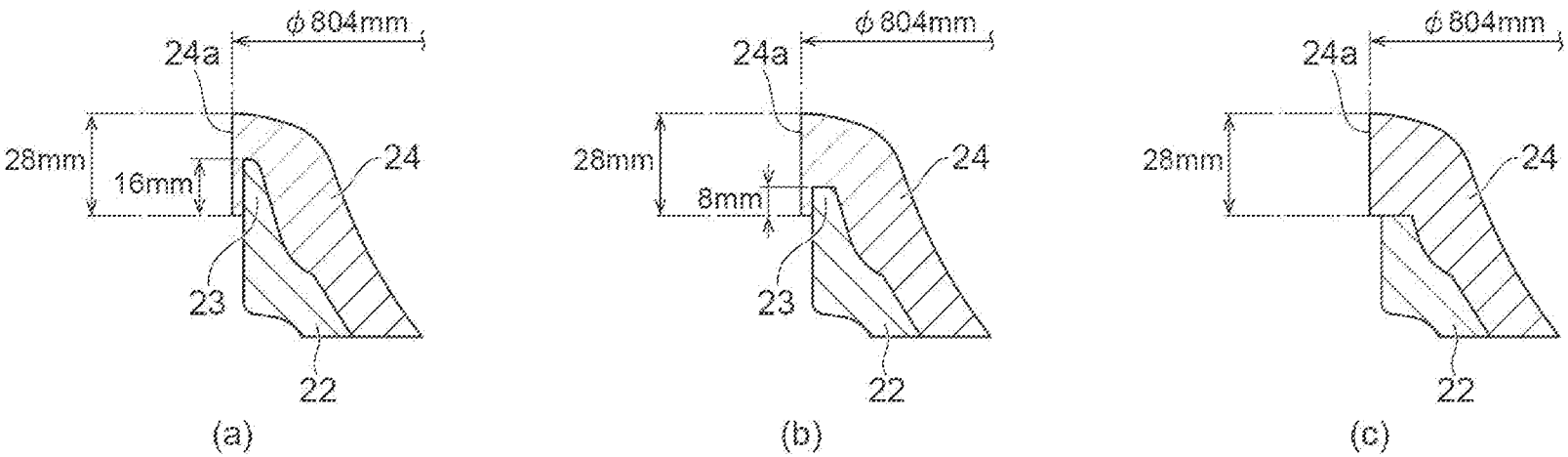
FIG. 4 is a diagram illustrating a barrel polishing apparatus according to Examples 1 to 3.

In Example 1, as shown in FIG. 4(*a*), the length of the end surface 24*a* of the second lining 24 in the axis Z direction was 28 mm, and the length from the lower end of the end surface 24*a* to the top of the convex portion 23 was 16 mm. The length of a part of the convex portion 23 overlapping the gap 40 in the axis Z direction was 15.15 mm. In Example 2, as shown in FIG. 4(*b*), the length of the end surface 24*a* of the second lining 24 in the axis Z direction was 28 mm, and the length from the lower end of the end surface 24*a* to the top of the convex portion 23 was 8 mm. The length of a part of the convex portion 23 overlapping the gap 40 in the axis Z direction was 7.15 mm. In Example 3, as shown in FIG. 4(*c*), the length of the end surface 24*a* of the second lining 24 in the axis Z direction was 28 mm, and the length from the lower end of the end surface 24*a* to the top of the convex portion 23 was 0 mm. That is, the convex portion 23 according to Example 1 is longer than the convex portion 23 according to Example 2, and the convex portion 23 is not provided in Example 3.

FIG. 5 shows the amount of change in the radius of the second lining 24 when the temperature of the second lining 24 is changed. As shown in FIG. 5, when the temperature increased by 1° C., the radius of the outer peripheral surface of the second lining 24 according to Examples 1 to 3 changed by 0.0113 mm/° C., 0.0131 mm/° C., and 0.0144 mm/° C. on average, respectively. From these results, it was confirmed that the longer the length L2 of the overlapping part 23*a* of the convex portion 23, the smaller the amount of change in the radius of the second lining 24, and as a result, the smaller the amount of change in the width d of the gap 40.

While the barrel polishing apparatus according to various embodiments has been described above, the present invention is not limited to the above-described embodiments, and various modifications can be made without departing from the scope of the invention.

For example, in the above-described embodiment, the retreat space 42 is formed between the inner circumferential surface 12*a* of the cylindrical rigid body 12 and the first lining 14, but the retreat space 42 is not necessarily formed. Even when the retreat space 42 is not formed, the presence of the convex portion 23 restricts the expansion toward the gap 40 side (radially outward), so that the amount of change in the width d of the gap 40 can be reduced.

REFERENCE SIGNS LIST

1: barrel polishing apparatus, 10: fixed tank, 12: cylindrical rigid body, 12*a*: inner circumferential surface, 14: first lining, 14*a*: inner circumferential surface, 18: flange, 20: rotary disk, 22: disk-shaped rigid body, 22*a*: central region, 22*b*: outer region, 23: convex portion, 23*a*: overlap part, 24: second lining, 24*a*: end surface, 26: coupling member, 28: rotating shaft, 31: passage, 32: support disk, 40: gap, 42: retreat space, 42*a*: end portion, 44: elastic member, 46: flange, S: polishing space, Z: axis.

The invention claimed is:

1. A barrel polishing apparatus comprising a polishing space defined by a fixed tank having a predetermined axis as a center axis and a rotary disk disposed below the fixed tank and rotatable about the predetermined axis, wherein, the fixed tank includes a cylindrical rigid body and a first lining covering an inner circumferential surface of the cylindrical rigid body;

the rotary disk includes a disk-shaped rigid body and a second lining covering a surface of the disk-shaped rigid body on the polishing space side, and is rotatably disposed in a state where a gap is formed between the first lining and the second lining;

the disk-shaped rigid body includes a convex portion protruding toward the polishing space along the predetermined axis direction, a periphery of the convex portion being covered with the second lining;

when viewed from a direction orthogonal to the predetermined axis, the convex portion overlaps the gap, and a length of a part of the convex portion overlapping the gap in the predetermined axis direction is one-third or more of a length of the gap in the predetermined axis direction;

a retreat space is formed between the inner circumferential surface of the cylindrical rigid body and the first lining;

the retreat space is formed at a position overlapping the gap when viewed from a direction orthogonal to the predetermined axis;

a passage communicating with the gap and the retreat space is formed on a side opposite to the polishing space of the disk-shaped rigid body, and an elastic body for preventing polishing liquid from entering the retreat space is provided in the passage so as to cover an end portion of the retreat space on the passage side, an annular first flange fixed to the cylindrical rigid body is provided below the cylindrical rigid body, and the elastic body is fixed to the first flange via a second flange.

2. The barrel polishing apparatus according to claim 1, wherein the disk-shaped rigid body includes a central region and an outer region surrounding the central region, and wherein the convex portion is provided in the outer region, and a thickness of the second lining on the convex portion is greater than a thickness of the second lining on the central region.

3. The barrel polishing apparatus according to claim 1, wherein the disk-shaped rigid body has a disk shape, and the convex portion is provided at a radially outer end portion of the disk-shaped rigid body.

4. The barrel polishing apparatus according to claim 2, wherein the disk-shaped rigid body has a disk shape, and the convex portion is provided at a radially outer end portion of the disk-shaped rigid body.

5. The barrel polishing apparatus according to claim 1, wherein the elastic body is a sponge packing.

6. The barrel polishing apparatus according to claim 5, wherein the sponge packing is fixed by a flange.

7. The barrel polishing apparatus according to claim 1, wherein grease is filled in the retreat space.

* * * * *